United States Patent [19]

Reynolds et al.

[11] 4,352,109

[45] Sep. 28, 1982

[54] END SUPPORTABLE DIPOLE ANTENNA

[76] Inventors: Donald K. Reynolds, 6365 Beach Dr. SW., Seattle, Wash. 98136; Louis P. C. Smithmeyer, 12009 30th Ave. SW., Seattle, Wash. 98146

[21] Appl. No.: 165,845

[22] Filed: Jul. 7, 1980

[51] Int. Cl.[3] ..... H01Q 1/52; H01Q 9/18

[52] U.S. Cl. ..... 343/792; 343/885

[58] Field of Search ..... 343/792, 846, 885, 802, 343/807

[56] References Cited

U.S. PATENT DOCUMENTS

| | | | |
|---|---|---|---|
| 2,184,729 | 12/1939 | Bailey | 343/846 |
| 2,508,438 | 5/1950 | Wilson et al. | 343/830 |
| 2,650,984 | 9/1953 | Mandel | 343/792 |
| 3,048,845 | 8/1962 | Becker | 343/830 |
| 3,587,109 | 6/1971 | Martino et al. | 343/830 |
| 3,588,903 | 6/1971 | Hampton | 343/830 |
| 3,618,107 | 11/1971 | Spanos | 343/846 |
| 3,919,710 | 11/1975 | Fletcher | 343/770 |
| 3,987,456 | 10/1976 | Celin | 343/830 |
| 4,031,539 | 6/1977 | Woodward | 343/797 |
| 4,208,662 | 6/1980 | Horn | 343/792 |
| 4,217,589 | 8/1980 | Stahler | 343/885 |

FOREIGN PATENT DOCUMENTS

| | | | |
|---|---|---|---|
| 886770 | 8/1953 | Fed. Rep. of Germany | 343/830 |

OTHER PUBLICATIONS

Reynolds, Facts About Proper VHF Vertical Antenna Design, Published 1979 by Advanced Electronic Applications, Inc., Lynnwood, Wash.

*Primary Examiner*—Eli Lieberman

[57] ABSTRACT

An end supported antenna having inner and outer elements extending outwardly from a supported end and of which the inner and outer elements each form one element of the dipole. Such antennas are driven centrally of the inner and outer ends or intermediate the ends between the dipoles. There is a decoupling sleeve on the inner element that functions as a coaxial transmission line of variable characteristic impedance on its inside and functions as a radiating element of the antenna on its outside. Generally, one or two sleeves are employed, the sleeves being of non-uniform cross section so as to be either conical or generally conical in shape, flaring from the supported end. A dielectric member separates the inner and outer elements and has an impedance matching network formed therewith. A support pipe extends outwardly from its supporting end to adjacent the impedance matching network. Coaxial conductors extend into the support pipe and the center coaxial conductor is connected to the outer element and the outer coaxial conductor is connected to the support pipe and to the decoupling sleeve or sleeves. Each sleeve may be secured to the support pipe by a single band clamp. The sleeves have resonant length greater than ¼ wavelength such as in the range of between 0.33 and 0.433 wavelength.

14 Claims, 15 Drawing Figures

Fig. 3
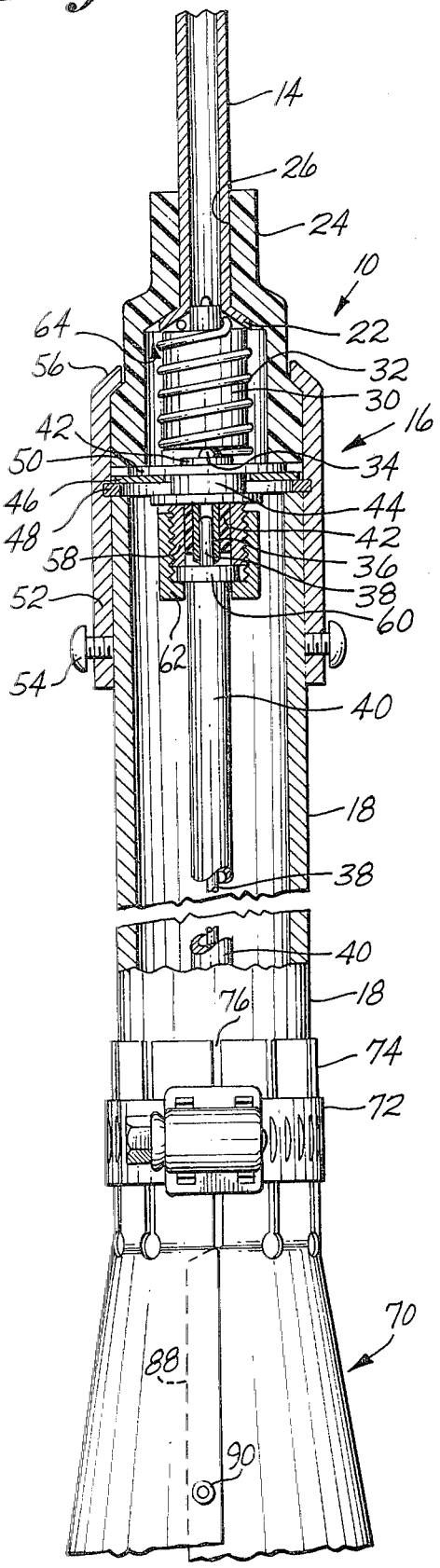
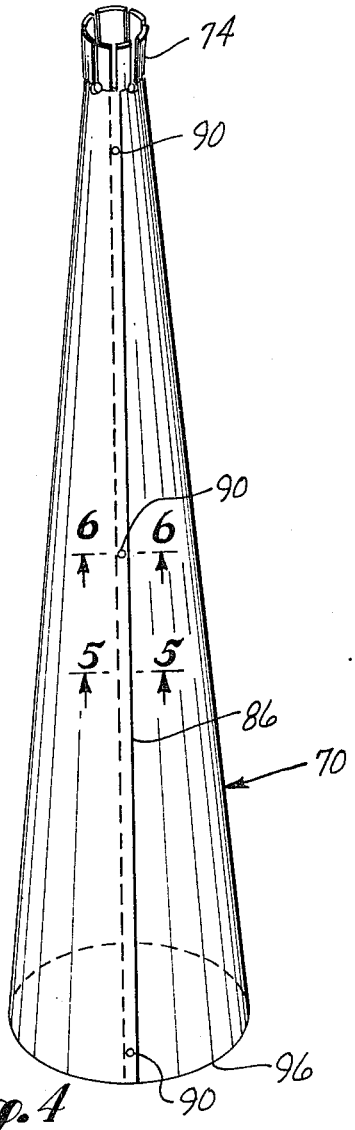
Fig. 4
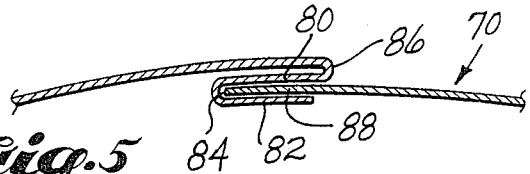
Fig. 5
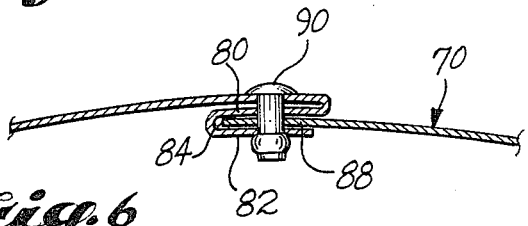
Fig. 6

Fig. 7
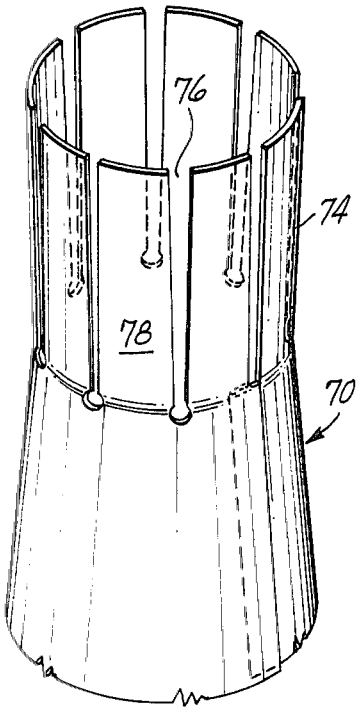
Fig. 8
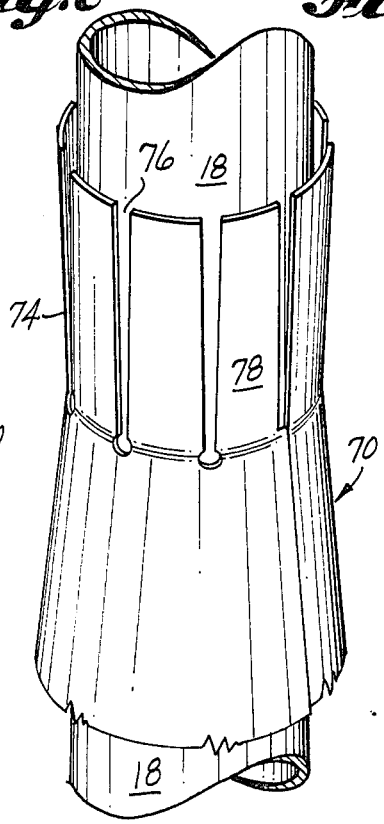
Fig. 9
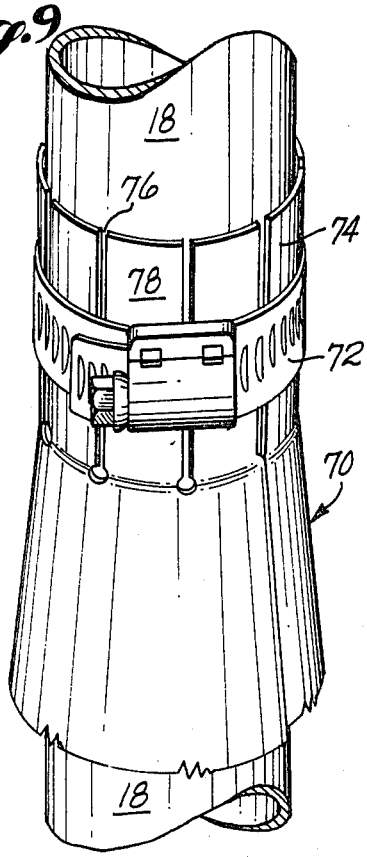
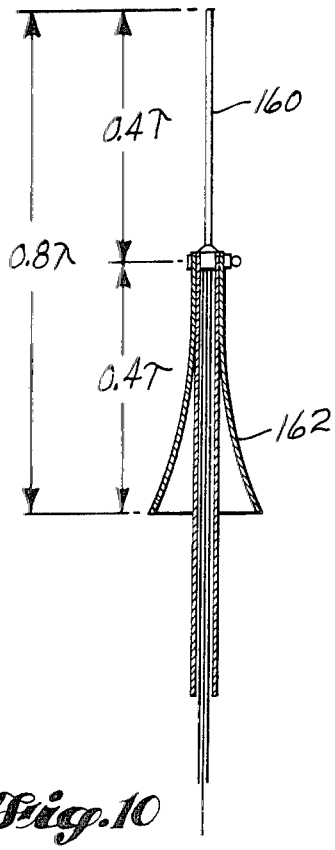
Fig. 10
Fig. 11
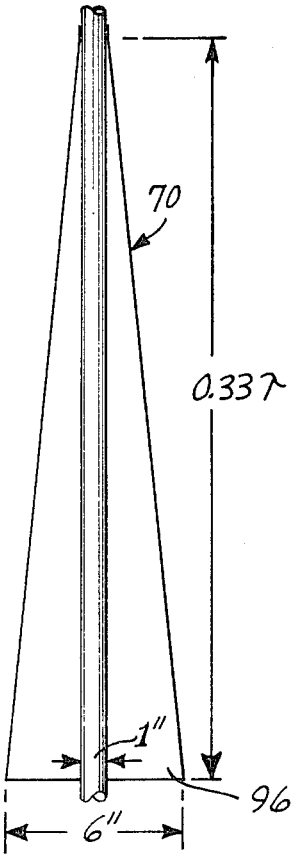

END SUPPORTABLE DIPOLE ANTENNA

BACKGROUND OF THE INVENTION

The present invention relates to antennas in which radiating portions are constructed of straight lengths of metallic wires, rods, or tubing. A transmission line extending between the antenna and the transmitter or receiver is connected to one extremity of the radiating portion of the antenna. Another feature of these antennas is that the radiating portion is elevated or mounted away from the surface of the antenna support. Thus, the invention is not concerned with antennas in which the radiating portion extends directly out from an extended conducting surface, such as a base-driven whip antenna mounted on the body of an automobile, or a vertical or whip tower antenna extending upwardly from the earth.

Precautions must be taken in order to inhibit the flow of radiating currents on auxiliary apparatus associated with antenna systems, such as on the transmission line connecting the antenna to a transmitter or a receiver, and on any metallic support or mast on which the antenna is mounted. Such radiating currents can severely distort and degrade the desired radiation characteristics of the antenna.

This problem has been described in U.S. Pat. No. 2,184,729 to Bailey, which covers means for correcting problems through the use of what is described as a "tubular counterpoise", now commonly called a "decoupling sleeve". What Bailey described as an antenna-counterpoise system is now called a sleeve dipole antenna, generally driven by a coaxial transmission line extending typically upwardly inside of the inner element of the dipole. Bailey refers to the outer dipole element as antenna 1 and part of the inner element as counterpoise 2, each of which is limited to ¼ wavelength and they constitute a vertical halfwave system. Bailey points out that the outer sheath 2, a decoupling sleeve, forms with the enclosed pipe a high impedance circuit or anti-resonant circuit. The desired decoupling action which inhibits the flow of current on the outside of the pipe support depends upon the resonance of the decoupling sleeve.

There is no reference in the Bailey Patent to the effects of the geometrical shape of the decoupling sleeve on the radiation characteristics of the antenna. All of Bailey's emphasis is on the prevention of unwanted currents on the structure within the decoupling system. In Bailey, the fact that a properly designed decoupling sleeve can simultaneously provide the desired decoupling and improve the radiation characteristics of the antenna is not suggested. This point is of great importance in the present invention.

The radiation patterns of sleeve dipoles with close fitting sleeves, as provided by Bailey, are seriously degraded in comparison with sleeves having diameters that are 5 times or more greater than the diameter of the support pipes or the coaxial lines therein. A large diameter ratio not only promotes better decoupling at the resonant frequency of the sleeve, but widens the bandwidth over which the decoupling is effective. This also is not indicated by Bailey.

Other pertinent prior art is found in a publication entitled, "Facts About Proper VHF Vertical Antenna Design", written by one of the applicants herein, and published by Advanced Electronic Applications, Seattle, Washington. FIG. 8 in the aforesaid publication illustrates a center driven dipole having a total length of 1¼ wavelengths, ⅝ wavelength on each leg. The coaxial line is brought up to the center of the dipole, where the center conductor excites the upper ⅝ wavelength element. The lower ⅝ element consists of the outside of the outer conductor, down for a distance of ⅜ wavelength from the feed point, and then the outside of a ¼ wavelength cylindrical decoupling sleeve. The lower ⅝ element terminates at the open end of the outer resonant ¼ wavelength sleeve. A second cylindrical resonant sleeve is fitted below the first in order to produce additional decoupling. Both of the foregoing sleeves are similar to that provided by Bailey in his patent.

In the foregoing prior art, the length of decoupling sleeves is chosen to be resonant to present high impedance in the path of any current on the outside of the sleeve to inhibit this current from continuing to flow along a supporting pipe below the open mouth of the sleeve or sleeves. The resonant condition for a cylindrical sleeve occurs at very nearly ¼ wavelength, and therefore, must be appreciably shorter than a conical or tapered sleeve of the present invention which is shown and described in part in the above-identified publication; and referred to as the "The AEA IsoPole TM antenna", FIG. 10, pages 15 and 16.

SUMMARY OF THE INVENTION

The present invention is an improved dipole antenna in which decoupling sleeves have resonant lengths greater than ¼ wavelength, the length of the sleeves being between 30% to 73% longer than the prior art ¼ wavelength cylindrical sleeves.

Whereas it was known that the resonant length of tapered coaxial lines was considerably greater than the ¼ wavelength characteristic of the prior cylindrical sleeve, it was surprisingly found that a tapered decoupling sleeve would act like a coaxial transmission line of variable characteristic impedance on the inside, and act like a radiating element of an antenna on the outside. The increase in resonant length of conical sleeves provides unexpected benefits in that the added length means that the desirable conical shape can extend over a greater percentage of a radiator. This provides improved impedance bandwidth of a broader range of frequencies without retuning.

Antennas with conical-shaped radiating elements have been used in the prior art where operation over very wide frequency bandwidths is necessary to give relatively constant input impedance and a relatively constant antenna radiation pattern over a broad frequency bandwidth. These desirable features result from the conical shape, which represents a gradual transfer of electromagnetic energy between the confines of the transmission line and the space into which the antenna radiates and receives energy. It is these desirable properties which are attained in part, by the use of the present invention, although the bandwidth over which the antenna is effective is limited by the resonant properties of the decoupling sleeve. However, there are many applications of great technical importance for which operation is limited to relatively narrow frequency bandwidths in the range of 1 to 10 or 20%, such as public service, namely, police, emergency services, marine communications and amateur radio, for example. For these applications, the conical decoupling sleeve, according to the invention, allows an improved impedance characteristic, that is, better impedance match, over the required band than that of the conventional sleeve dipole.

Prior art cylindrical decoupling sleeves are difficult to mount on the antenna and are particularily difficult because of the requirement that the mouth be 5 times or greater in diameter than that of the supporting pipe or coaxial line. It was found according to the invention that generally conical-shaped sleeves, sleeves having non-uniform cross sections, are easier to mount on a support pipe, namely, by means of a simple band clamp. In addition, the conical shape increases the rigidity of the sleeve in comparison to that of the cylindrical sleeve.

The conical-shaped sleeves have structural advantages over the cylindrical in that they are made of one flat sheet so as to be less expensive, and the cylindrical construction requires an end cap or disc of great stiffness. They are also more rigid than the cylindrical, have greater resistance to the wind damage, and they are loaded less by snow and ice. They also are much easier to make with a large mouth relative to the supporting pipe and/or coaxial cable.

It is not essential that the decoupling sleeves according to the invention be of precise conical shape in that it has been found that other tapers produce similar benefits and add additional control that can be exerted on the resonant length of the sleeve. Generally the invention provides for resonant sleeves of cross sections having diameters that vary along the axial directions.

Further objects and advantages of the invention may be brought out in the following part of the specification wherein small details have been described for the competence of disclosure, without intending to limit the scope of the invention which is set forth in dependent claims.

BRIEF DESCRIPTION OF THE DRAWINGS

Referring to the accompanying drawings, which are for illustrative purposes:

FIG. 3 is an enlarged fragmentary, elevational view from the antenna shown in FIG. 1;

FIG. 4 is a perspective view of a decoupling sleeve according to the invention;

FIG. 5 is a fragmentary cross-sectional view taken along the line 5—5 in FIG. 4;

FIG. 6 is a fragmentary cross-sectional plan view taken along the line 6—6 in FIG. 4;

FIG. 7 is an enlarged fragmentary perspective view of the top of the sleeve shown in FIG. 4;

FIG. 8 is a view of the sleeve shown in FIG. 7 having a support pipe extending therethrough;

FIG. 9 is a view of the sleeve and supporting pipe with a band clamp securing the sleeve to the pipe;

FIG. 10 is an elevational, partially cross-sectional view of another embodiment of a dipole antenna;

FIG. 11 is an elevational schematic view of a decoupling sleeve similar to those shown in FIG. 1;

DESCRIPTION OF THE PREFERRED EMBODIMENTS

Figure 1:
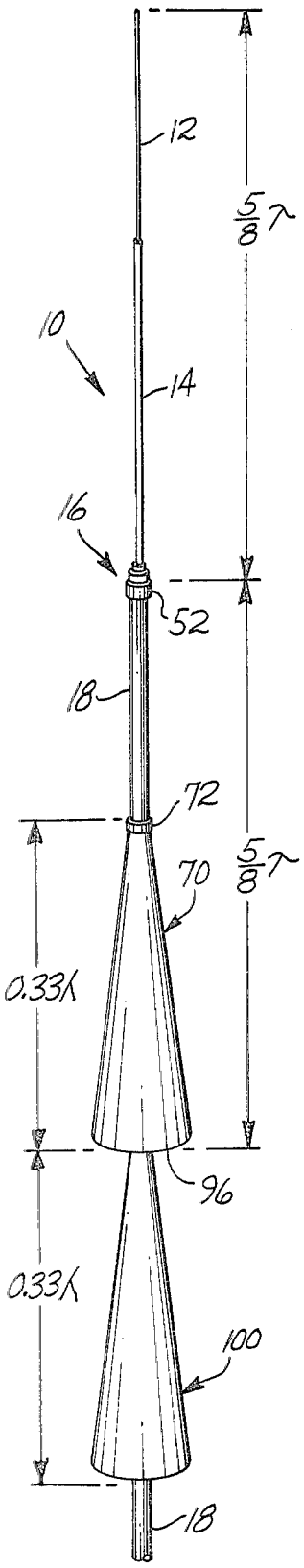
FIG. 1 is a perspective view of a dipole antenna according to the invention.

Referring again to the drawings, there is shown in FIG. 1 an inner end-supportable, center driven dipole antenna, generally designated as 10, shown having a two part outer or upper element or rod 12, 14. The antenna may be supported at its lower or inner end to be vertical or at an angle thereto. The rod 12, 14 is fixed by a clamp, not shown, so that the upper element has the length of $\frac{5}{8}$ wavelength. The upper element is connected at 16 to an inner or lower element portion of a conductive support mast 18. The lower element or pole also has a length of $\frac{5}{8}$ wavelength so that the total length of the dipole is $1\frac{1}{4}$ wavelengths.

The dipole connecting arrangement at 16 includes an impedance matching network, shown in detail in FIG. 3. The rod parts 12, 14 are conductors, such as aluminum. Lower end 22 of the rod part 14 is flared to fit within a conical portion of a dielectric support 24 made of Delrin, for example. The rod part 14 extends upwardly through a cylindrical opening 26 in which it is snugly fitted so as to be watertight. Against the flared end 22, there is a cylindrical dielectric 30 having a spiral copper coil wrapped therearound. An upper end of the copper coil makes electrical contact with the flared end 22. A lower end of the coil makes contact with a conductor 34 which extends into a conducting sleeve 36 and into which extends an inner conductor 38 of a coaxial cable having an outer conductor 40.

The sleeve 36 extends through dielectric sleeve 42 which is fitted in a conducting ring 44. The upper end of ring 44 has a flange 50 abutting a conducting ring 46 which in turn is in contact with a snap ring 48 secured between the ring 46 and the upper end of the support pipe 18. The snap ring 48 is fitted within a groove in a generally cylindrical conducting and weather shielding member 52, secured to the pipe 18 by means of screws 54 and swaged over a conical surface of the dielectric 24 at 56 so as to provide a watertight fit over the impedance matching network.

The ring 44 has a lower threaded end 58 in contact with a connecting flange 60 on the upper end of the outer coaxial conductor 40, secured in place by a flanged sleeve 62 threadedly engaged with the member 58.

Thus, the inner conductor 38 is connected directly through the coil to the upper or outer element 14, 16 of the antenna and the outer coaxial conductor 40 is connected to the support pipe 18 and to the member 52. A capacitor 64 is formed between the member 52 at the end 56 and the flared end 22 of the element 14, the gap being in the dielectric 24.

In this arrangement the support pipe or mast 18 becomes a part of the outer coaxial conductor for a distance equal to $\frac{5}{8}$ wavelength as shown in FIG. 1. In order that the coaxial cable and the mounting structure do not become inadvertent parts of the antenna, a conical decoupling sleeve 70 is positioned on the supporting pipe 18 and secured thereto by means of a screw-tightened band clamp 72. The securing end 74 of the sleeve is shown in detail in FIGS. 3, 4, and 7–9. The end 74 is slotted as at 76 so as to form legs 78 which can be easily conformed to the support pipe 18 when the band clamp is tightened thereon.

One of the advantages of the conical decoupling sleeve is that it can be easily formed, and along one vertical edge, FIGS. 4–6, runs 80 and 82 are folded to form a slot 84 inwardly of edge 86 and into which opposite end 88 is fitted. Three rivets 90 through the outer surface, the runs 80 and 82, the slot 84, and the edge 88 hold the sleeve securely together through typical bad weather conditions. The sleeve may be made of relatively thin aluminum which is easy to form and which will stand considerable external forces. In order to function properly as a decoupler, the sleeve need not be absolutely centered around the support pipe or the coaxial cables.

Another advantage of the conical-shaped sleeve decoupler is an inherent, large mouth 96 at its lower end. For best results the diameter of the mouth should be at least 5 times the diameter of the coaxial cable or of the support pipe outwardly thereof. In FIG. 11 the sleeve 70 is shown to have a 6 to 1 ratio over the support pipe which has an outer diameter of 1 inch, the sleeve having an open mouth diameter of 6 inches.

As shown in FIG. 1, the regular cone sleeve 70 is positioned so that its lower end is at a distance of $\frac{5}{8}$ wavelength from the feed point 52, the sleeve having a resonant length of 0.33 wavelength. The resonant length of a prior art cylindrical sleeve for the same wavelength antenna is $\frac{1}{4}$ wavelength, and thus, the present invention structure requires a significantly longer sleeve than the prior uniform cross section sleeves. Therefore, the conical sleeve extends over a greater percentage of the radiator than the uniform cross section sleeves and improves the impedance so as to have a broader range of frequencies without requiring retuning. That is, the conical shape causes the input impedance to be more nearly constant over a given band of frequencies than do the prior uniform cylindrical shape.

The spill-over current which must be equal to the current at the base of the upper or outer element will constitute the current entering the lower or inner element of the dipole. The lower $\frac{5}{8}$ element terminates at the open end of the 0.33 wavelength sleeve and tests show the presence of a small amount of spill-over current below this sleeve. Accordingly, a second resonant sleeve 100, FIG. 1, identical to the sleeve 70, is used to produce a higher degree of decoupling. For the antenna, shown in FIG. 1, upper and lower current loops would be in phase with each other. This is the desired action which produces the gain.

Figure 2:
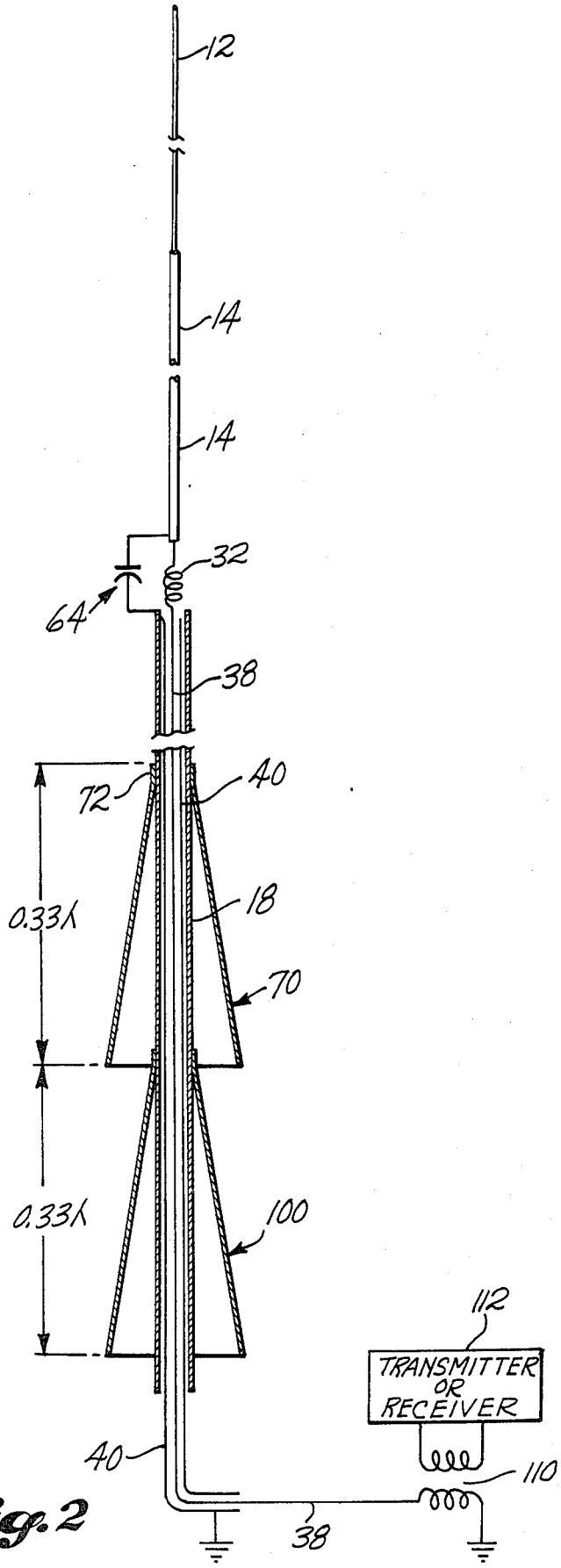
FIG. 2 is an elevational schematic view of the invention shown in FIG. 1.

In FIG. 2 the antenna 10 and its circuitry are shown schematically. The antenna is connected by the coaxial line 38, 40 through a transformer 110 to a translation device 112 which may be either a transmitter or a receiver.

The inner conductor 38 is connected to the coil 32, directly connected to the outer element 14. The upper end of the outer conductor 40 is connected to the upper end of support pipe 18 and to the conical decoupling sleeves 70 and 100. Connected to the upper ends of the support and to the conical sleeves is the capacitor 64 which in turn is connected to the outer element 14.

Figure 15:
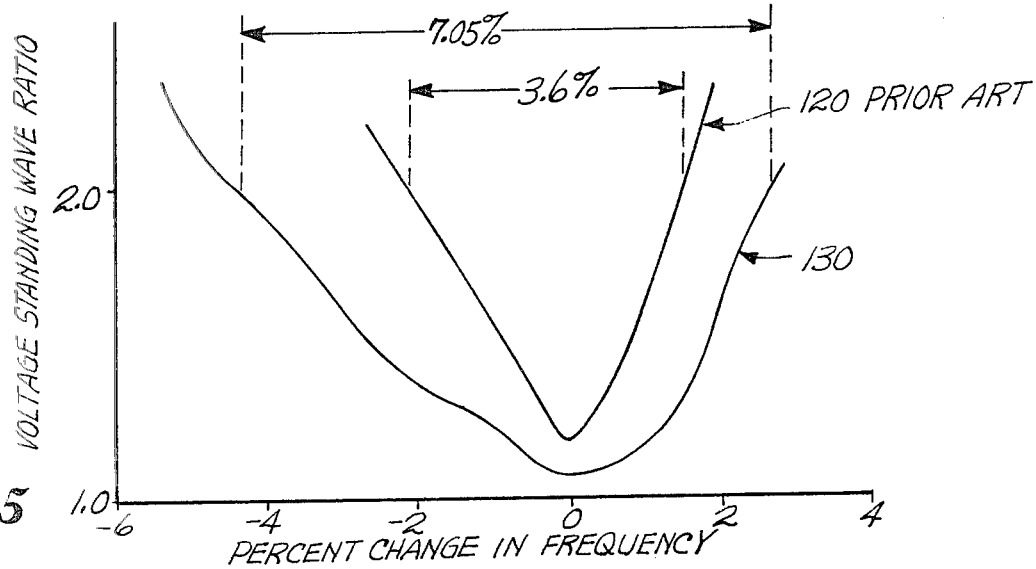
FIG. 15 is a graph showing measurements of voltage standing wave ratio versus percentage change of frequency to illustrate the bandwidth increase of the decoupling sleeve according to the invention in comparison with that of the prior art.

In FIG. 15 there are graphs showing the measured impedance bandwidths of two $1\frac{1}{4}$ wavelengths dipoles, the graph 120 being for an antenna having cylindrical decoupling sleeves and the graph 130 being for an antenna having the conical decoupling sleeves, as shown in FIGS. 1 and 2. The measurements show the voltage standing wave ratio versus percentage change of frequency on a 50 ohm coxial transmission line connected to each of the antennas. As shown in FIG. 15, the percent change in frequency for the antenna having the uniform cross section decoupling sleeves is 3.6% and the percentage change in frequency for the present invention is 7.05% where the voltage standing wave ratio is 2.0.

In FIG. 10 there is another embodiment of the invention. Here the outer element 160 has the length of 0.4 wavelength and the inner element is the length of the decoupling sleeve 162 which has a length of 0.4 wavelength for a center driven dipole whose total length is 0.8 wavelength.

This embodiment illustrates a decoupling sleeve which is of non-uniform cross section, generally conical but not a true cone, as distinct from those shown in FIGS. 1 and 2. Again, in contrast to the prior art, here the length of the radiating decoupling sleeve is 0.4 wavelength, whereas in the prior art the uniform cross section decoupling sleeve would have a resonant length of $\frac{1}{4}$ wavelength.

Figure 12:
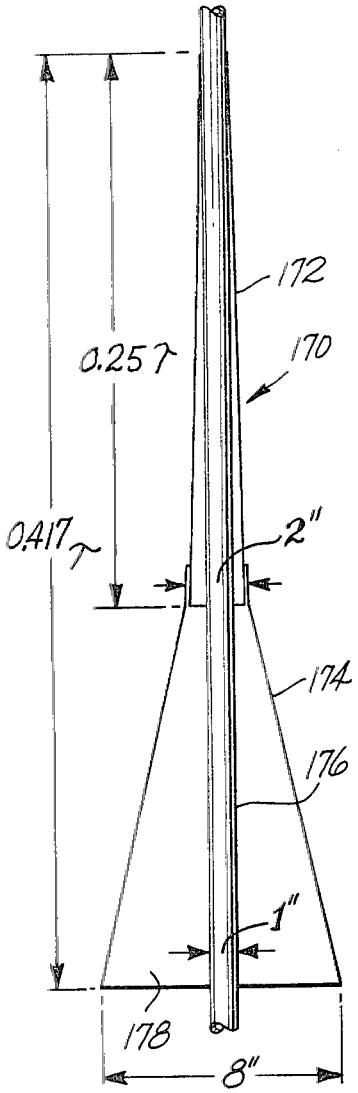
FIG. 12 is an elevational schematic view of a decoupling sleeve having varying conical portions.

In FIG. 12, a decoupling sleeve 170 is shown, formed of two generally conical elements 172 and 174. The resonant length for such a decoupling sleeve is 0.417 wavelength, with a 2" large-diameter cone having a resonant length of 0.25 wavelength. The support tube 176 has a diameter of 1" and the large mouth 178 has a diameter of 8 inches so as to provide an 8 to 1 ratio between the large open mouth and the support or coaxial line.

Figure 13:
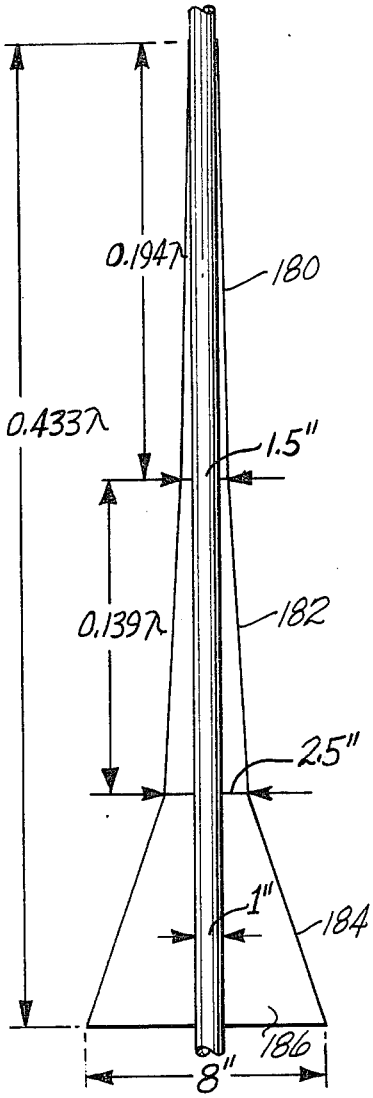
FIG. 13 is an elevational view of another example of a decoupling sleeve having varying conical portions.

In FIG. 13 there are three cone sections 180, 182 and 184, forming a decoupling sleeve of non-uniform cross section. The sleeve portion 180 has a maximum diameter of 1.5 inches and a resonant length of 0.194 wavelength; the cone section 182 has a maximum diameter of $2\frac{1}{2}$ inches and a resonant length of 0.139 wavelength; and the cone section 184 has a maximum diameter of 8 inches in contrast to the support or coaxial line having a diameter of 1 inch so as to provide an 8 to 1 ratio between the open mouth 186 and the latter. As shown, the total resonant length of the sleeve is 0.433 wavelength or about 73% greater than the 0.25 wavelength for a cylindrical sleeve of any diameter.

Figure 14:
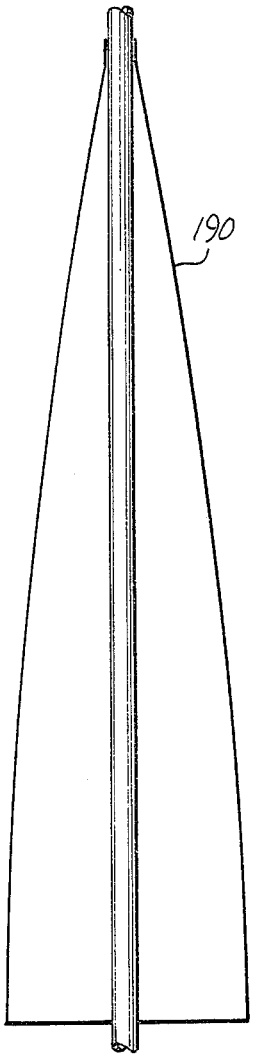
FIG. 14 is an elevational view of a decoupling sleeve having non-uniform generally circular cross sections.

In FIG. 14 another generally conical decoupling sleeve 190 is illustrated. The sleeve is of non-uniform cross section but has greater diameters than a regular cone. Like the sleeves shown in FIGS. 12 and 13, the sleeve in FIG. 14 would have a resonant length of substantially more than 0.25 wavelength.

Herein the term "substantially conical" is used to mean any of the types of sleeves which have been illustrated and any other type of sleeve having a small diameter apex end and which increases in diameter in some manner as it extends from the apex and to a large diameter open mouth end.

The invention and its attendant advantages will be understood from the foregoing description and will be apparent that various changes may be made in the form, construction, and arrangement of the parts of the invention without departing from the spirit and scope thereof or sacrificing its material advantages, the arrangements hereinbefore described being merely by way of example. We do not wish to be restricted to the specific form shown or uses mentioned except as defined in the accompanying claims.

What is claimed is:

1. An end supportable, center driven, dipole antenna, comprising:

a conductive support mast having an outer end;

means at said outer end for electrically connecting said mast to a first conductor of an antenna circuit;

a conductive rod extending endwise outwardly from the outer end of said support mast, said rod having an inner end;

means at said inner end for electrically connecting said rod to a second conductor of an antenna circuit;

dielectric connector means at the outer end of said support mast for connecting said rod and said mast together and electrically insulating each from the other; and a continuous conductive generally conical sleeve of resonant length greater than one quarter wave length, said sleeve having a small diameter outer apex end which is both structurally and electrically connected to said mast, a large diameter inner mouth end which extends circumferentially about the mast and is spaced radially outwardly from the mast a distance sufficient to open-circuit the antenna at that location, and inner and outer surfaces, wherein the inner mouth of the sleeve is the inner extremity of the dipole, and wherein said sleeve is of a length sufficient to effectively serve as a coaxial transmission line of variable characteristic impedance on its inside and as a radiating element of the antenna on its outside.

2. An antenna according to claim 1, in which:

said means electrically connecting the rod to a second connector of an antenna circuit includes an impedance matching network.

3. An antenna according to claim 1 in which:

said sleeve has a resonant length in the range of about 1.3 to 1.73 quarter wavelengths.

4. An antenna according to claim 1, including:

coaxial transmission conductors in said support mast;

the center coaxial conductor being electrically connected to the inner end of said rod;

the outer coaxial conductor being connected to the outer end of the mast.

5. An antenna according to claim 1 in which:

said sleeve is secured to said support mast by a band clamp.

6. An antenna according to claim 1 in which:

the ratio of the diameter of the mouth end of the sleeve to the support mast diameter is in the range of 5 through 8 to 1.

7. An antenna according to claim 1 in which:

the length of said rod is about 0.4 wavelength; and said sleeve has a length of about 0.4 wavelength and is connected to outer end of said mast.

8. An antenna according to claim 1 in which:

said sleeve has a length in the range of generally between 0.33 to 0.433 wavelength.

9. An antenna according to claim 1 in which:

said small diameter outer apex end of said sleeve is spaced axially inwardly from the outer end of the mast.

10. An antenna according to claim 9 in which:

the length of said rod is about 0.625 wavelength and the distance from the outer end of the mast to the open mouth of the sleeve is about 0.625 wavelength so that the total length of the dipole is about 1.25 wavelengths.

11. The length of the dipole according to claim 10 in which:

the length of said sleeve is about 0.33 wavelength.

12. An antenna according to claim 11, further comprising:

a secondary sleeve secured to said pipe axially inwardly of said main sleeve;

said secondary sleeve being generally of the same configuration and size as the main sleeve;

said secondary sleeve having its small diameter outer apex end radially adjacent the large diameter inner mouth end of the first sleeve.

13. An antenna according to claim 1, wherein the outer apex end of the sleeve is formed to include a plurality of elongated, axially extending legs which are separated circumferentially by axially extending slots, said legs being formed to closely conform to the cylindrical shape of the mast.

14. An antenna according to claim 13 in which:

said sleeve is secured to said support mast by a band clamp which surrounds said legs.

* * * * *